US010724513B2

(12) United States Patent
Mead et al.

(10) Patent No.: US 10,724,513 B2
(45) Date of Patent: Jul. 28, 2020

(54) PERISTALTIC PUMP

(71) Applicant: Watson-Marlow Limited, Cornwall (GB)

(72) Inventors: Robert Mead, Cornwall (GB); Steven Brokenshire, Cornwall (GB)

(73) Assignee: Watson-Marlow Limited, Cornwall (GB)

( * ) Notice: Subject to any disclaimer, the term of this patent is extended or adjusted under 35 U.S.C. 154(b) by 204 days.

(21) Appl. No.: 15/758,680

(22) PCT Filed: Sep. 9, 2016

(86) PCT No.: PCT/GB2016/052799
§ 371 (c)(1),
(2) Date: Mar. 8, 2018

(87) PCT Pub. No.: WO2017/042581
PCT Pub. Date: Mar. 16, 2017

(65) Prior Publication Data

US 2018/0245579 A1 Aug. 30, 2018

(30) Foreign Application Priority Data

Sep. 11, 2015 (GB) ..... 1516145.8

(51) Int. Cl.
*F04B 43/12* (2006.01)

(52) U.S. Cl.
CPC ..... *F04B 43/1292* (2013.01); *F04B 43/1253* (2013.01)

(58) Field of Classification Search
CPC .. F04B 43/1253; F04B 43/1292; F04B 45/08; F04B 43/086
See application file for complete search history.

(56) References Cited

U.S. PATENT DOCUMENTS 3,791,777 A * 2/1974 Papoff ..... F04B 43/1292 417/475
4,834,630 A 5/1989 Godwin
4,997,347 A 3/1991 Roos
(Continued)

FOREIGN PATENT DOCUMENTS

CN 102878064 A 1/2013
JP S58500792 A 5/1983
(Continued)

OTHER PUBLICATIONS

Search Report of the U.K. Patent Office for Application GB1516145.8 dated Mar. 8, 2016.
(Continued)

*Primary Examiner* — Bryan M Lettman
(74) *Attorney, Agent, or Firm* — Honigman LLP

(57) ABSTRACT

A peristaltic pump includes a rotor and a track assembly. The track assembly is spaced from the rotor to receive n tubes therebetween, where n=2m with m a positive integer ≥2. The tubes are manifolded to one another at a discharge port. One of the rotor and the track includes an occlusion surface for each of the n tubes. The occlusion surfaces are located at n different angular positions. The angular offset between the occlusion surfaces offsets pulsation associated with each tube so as to reduce overall pulsation at the discharge port.

9 Claims, 3 Drawing Sheets

(56) References Cited

U.S. PATENT DOCUMENTS

| | | | | |
|---|---|---|---|---|
| 5,257,917 | A * | 11/1993 | Minarik | F04B 43/1292 417/475 |
| 5,846,061 | A | 12/1998 | Ledebuhr et al. | |
| 8,366,420 | B1 | 2/2013 | Geschwender | |
| 2014/0271273 | A1 | 9/2014 | Carpenter | |

FOREIGN PATENT DOCUMENTS

| | | | |
|---|---|---|---|
| JP | 2000018165 | A | 1/2000 |
| JP | 201241854 | A | 3/2012 |
| JP | 201474349 | A | 4/2014 |
| WO | 198204291 | A1 | 12/1982 |

OTHER PUBLICATIONS

International Search Report for Application PCT/GB2016/052799 dated Nov. 10, 2016.
Examination Report from Taiwan Patent Office for Apptcation 105129298 dated Jan. 2, 2018.
Office Action for Japanese Application No. 2018-512259 dated Aug. 27, 2019 along with English translation.

* cited by examiner

PERISTALTIC PUMP

TECHNICAL FIELD

The invention relates to a peristaltic pump and particularly, but not exclusively, to a peristaltic pump having an arrangement to reduce pulsation.

BACKGROUND

In a peristaltic pump, the pumped fluid contacts only the bore of a tube, thereby eliminating the risk of the pump contaminating the fluid. Peristaltic pumps are therefore often used to pump sterilized fluids, and thus find applications particularly in the biopharmaceutical industry.

In a peristaltic pump, a compressible tube is squeezed between a roller and a track on an arc of a circle, creating a seal at the point of contact. As the roller advances along the tube, the seal also advances. After the roller has passed, the tube returns to its original shape, creating a partial vacuum which is filled by fluid drawn from the suction port.

Before the roller reaches the end of the track, a second roller compresses the tube at the start of the track, isolating a packet of fluid between the compression points. As the first roller leaves the track, the second continues to advance, expelling the packet of fluid through the pump's discharge port. At the same time, a new partial vacuum is created behind the second roller into which more fluid is drawn from the suction port.

The fluid discharged by peristaltic pumps exhibits a characteristic pulsation in pressure generated by the pumping method. Some applications are sensitive to pulsating fluid flow. and so steps may be taken to reduce the pulsation. For example, the pulsation amplitude may be reduced using two channels which are out of phase from one another and are manifolded to one another on the discharge side of the pump. This may be achieved using a rotor with two offset sections or a pair of offset tracks. This is known to deliver a net reduced pulse amplitude and increased pulse frequency but only at a system pressure of up to 2 bar. With system pressures of 2-4 bar, the pulse amplitude grows significantly, and is very difficult to control to less than 0.5 bar without additional system pulsation damping devices.

It is therefore desired to provide a peristaltic pump which exhibits reduced pulsation characteristics.

SUMMARY

In accordance with an aspect of the invention there is provided a peristaltic pump comprising: a rotor; a track assembly spaced from the rotor to receive n tubes therebetween, where n=2m with m a positive integer ≥2, the tubes being manifolded to one another at a discharge port; wherein one of the rotor and the track assembly comprises an occlusion surface for each of the n tubes; wherein the occlusion surfaces are located at n different angular positions, the angular offset between the occlusion surfaces offsetting pulsation associated with each tube so as to reduce overall pulsation at the discharge port.

The n tubes may comprise m pairs of tubes, wherein each of the tubes within a pair have substantially the same diameter and wherein at least two of the pairs of tubes have different diameters.

The pairs of tubes may be arranged such that the angular positions of the corresponding occlusion surfaces are interleaved for a pair of smaller tubes and a pair of larger tubes.

Te angular offset θ between each occlusion surface may be substantially equal to v/n, where v is a swept volume of the occlusion surface.

The track assembly may comprise n track sections each defining one of the occlusion surfaces, wherein the track sections are angularly offset from one another.

The rotor may comprise a plurality of rollers.

BRIEF DESCRIPTION OF THE DRAWINGS

For a better understanding of the invention, and to show more clearly how it may be carried into effect, reference will now be made, by way of example, to the accompanying drawings, in which:—

DETAILED DESCRIPTION

Figure 1:
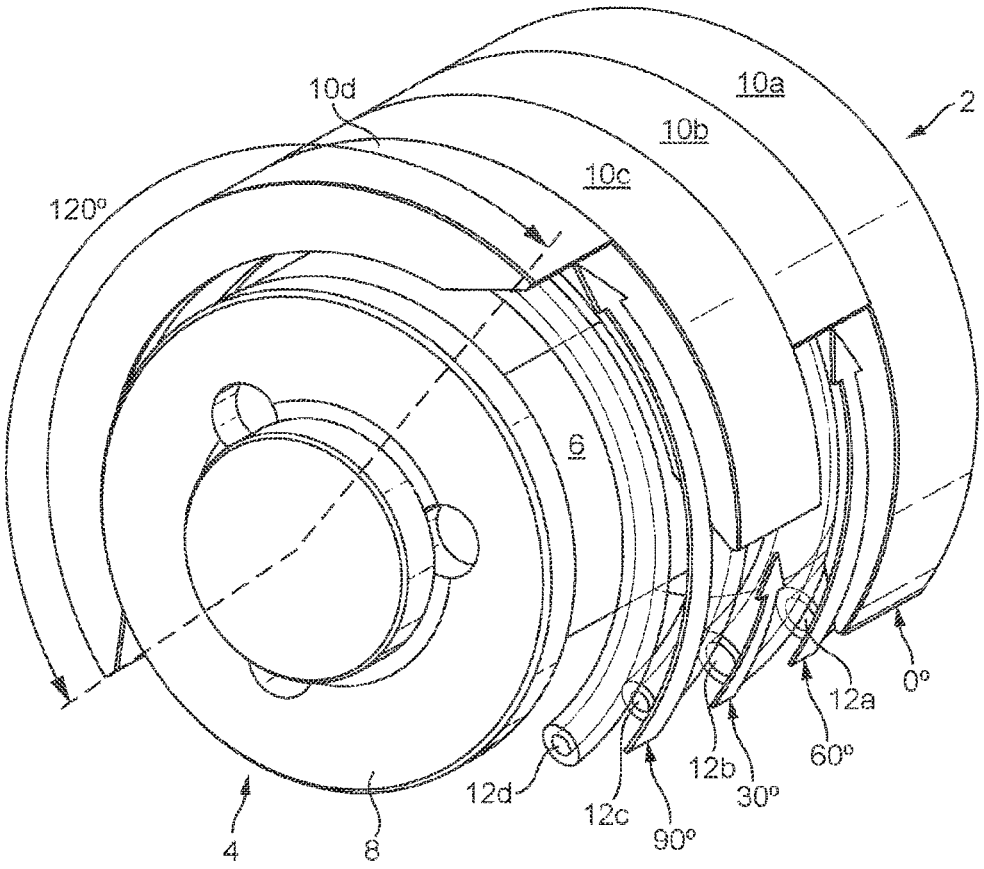
FIG. 1 is a perspective view of a pumphead of a peristaltic pump according to an embodiment of the invention.

FIG. 1 shows a pumphead 2 according to an embodiment of the invention. The pumphead comprises a rotor 4 which is rotatably mounted within a pumphead body (not shown). The rotor 4 is provided with a central shaft (not visible) and three cylindrical rollers 6 which extend between a pair of endcaps 8. The central shaft is located at the center of the endcaps 8 and the rollers 6 are offset radially from the central shaft, but parallel thereto. The rollers 6 are each provided at the same radial distance from the central shaft but are offset from one another circumferentially. Specifically, the rollers 6 are offset from one another by 120° such that they are evenly spaced circumferentially.

At least one of the endcaps 8 is provided with a drive portion which can be connected to a complementary portion (such as a splined or keyed shaft) of a drive unit for rotating the rotor 4 about the central shaft. The rollers 6 are rotatably mounted to the endcaps 8 by ball bearings such that they can rotate relative to the endcaps 8 about their longitudinal axes.

The pumphead 2 further comprises a track assembly comprising four arcuate tracks 10*a*, 10*b*, 10*c*, 10*d* (collectively referred to as the tracks 10). The tracks 10 are spaced axially along the length of the rotor 4 between the endcaps 8. The tracks 10 partially extend around the circumference of the rotor 4. Specifically, the tracks 10 each have an arc of 120°. The length of the tracks 10 thus corresponds to the spacing of the rollers 6 (the swept volume). The tracks 10 are offset from one another. Specifically, with reference to the track 10*a* (which is at 0°), the track 10*b* is offset by 60°, the track 10*c* is offset by 30° and the track 10*d* is offset by 90°, such that, in total, the tracks 10 extend around an arc of 210°. Therefore, each track 10 is offset from every other track 10.

The track assembly is provided as part of a cover section (not shown) of the pumphead 2. The cover section is separable from the pumphead body and the rotor 4, such that the tracks 10 can be spaced from the rollers 6.

Four compressible tubes 12*a*, 12*b*, 12*c*, 12*d* (collectively referred to as the tubes 12) are disposed respectively between the tracks 10*a*, 10*b*, 10*c*, 10*d* and the rollers 6. The tubes 12 are fluidically connected to one another by a manifold (not shown) both upstream and downstream of the rotor 4 (the suction and discharge sides of the pump) such that the pumphead 2 has a single suction port (inlet) and a single discharge port (outlet).

Although not shown, the tubes 12 and the manifolds may be supplied as a unified cartridge which holds the tubes 12 in the proper positions and thus aids installation of the tubes 12, preventing them from becoming kinked or twisted. The cartridge may seal the tubes within a flexible (polymer) membrane so as to contain any particulates (spall) from the tubes 12 which may otherwise enter the processing area. The cartridge may be C-shaped with a profile which conforms to the 210° arc of the tracks 10. The cartridge may be resiliently flexible so as to allow it to be received over the rotor 4. Alternatively, the cartridge may be formed as two hinged (or separable) sections which can be locked in position after installation. In certain applications, particularly biopharmaceutical applications, the cartridge may be a single-use, disposable item which is disposed of after a single use or use-period. The cartridge may protect the tube during gamma irradiation cycles and enable incorporation of ancillary items such as pressure transducers and RFID tags.

Rotation of the rotor 4 causes the tubes 12 to be sequentially occluded between the rollers 6 and the tracks 10. Specifically, rotation (in an anticlockwise direction as viewed in FIG. 1) of the rotor 4 causes the tube 12*a* to be compressed against the track 10*a* by one of the rollers 6, thereby occluding the tube 12*a* and forcing the pumped fluid along it in a downstream direction (assuming it is already primed). As the rotor 4 is rotated by a further 30° the same roller 6 then compresses the tube 12*c* against the track 10*c*. A further rotation of 30° (a total of 60°) then causes the same roller 6 to compress the tube 12*b* against the track 10*b*, and a further rotation of 30° (a total of 90°) causes the same roller 6 to compress the tube 12*d* against the track 10*d*. At a rotation of 120°, the roller 6 releases the tube 12*a* only for it to be compressed by the next roller 6 which begins priming the tube 12*a*.

It will be appreciated that at the discharge port, the pulses from each of the tubes 12 are superposed. The offset of each of the tracks 10 causes the pulses to be out of phase such that they destructively interfere, thereby reducing the amplitude of pulsation.

In the example shown, the tubes 12*a* and 12*b* have a first, larger diameter and the tubes 12*c* and 12*d* have a second, smaller diameter. The larger diameter tubes 12*a*, 12*b* are thus offset from one another by 60° and the smaller diameter tubes 12*c*, 12*d* are offset from one another by 60°. This combination of smaller and larger diameter tubes has been found to be particularly effective at reducing the amplitude of pulsation.

Figure 2:
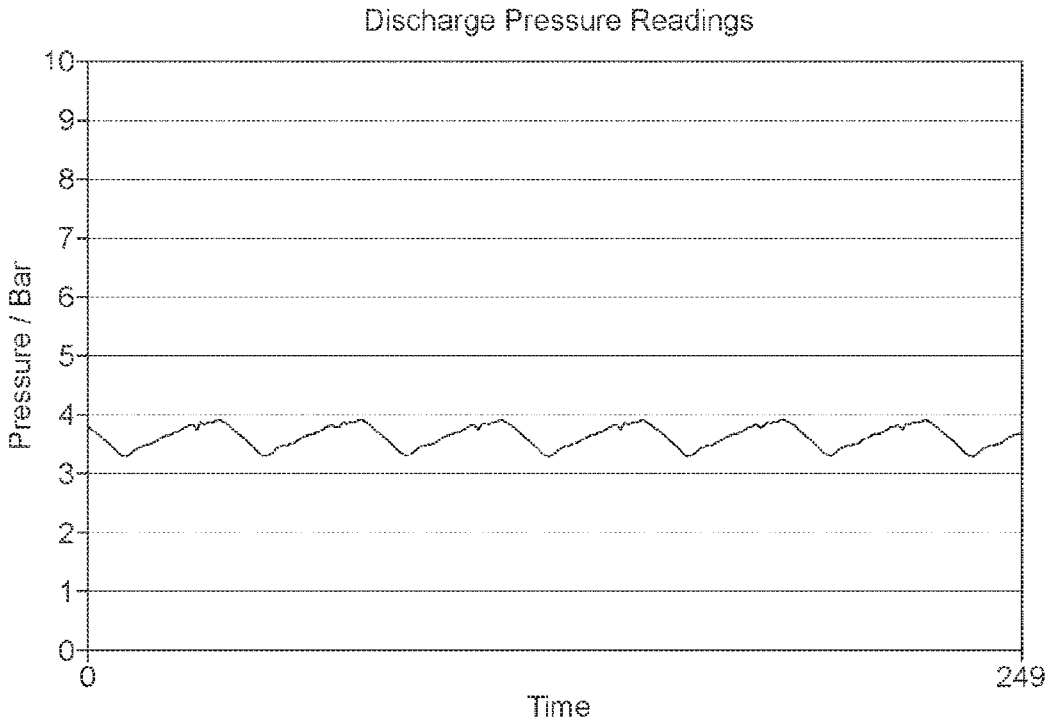
FIG. 2 is a graph of discharge pressure against time for a single large channel.
Figure 3:
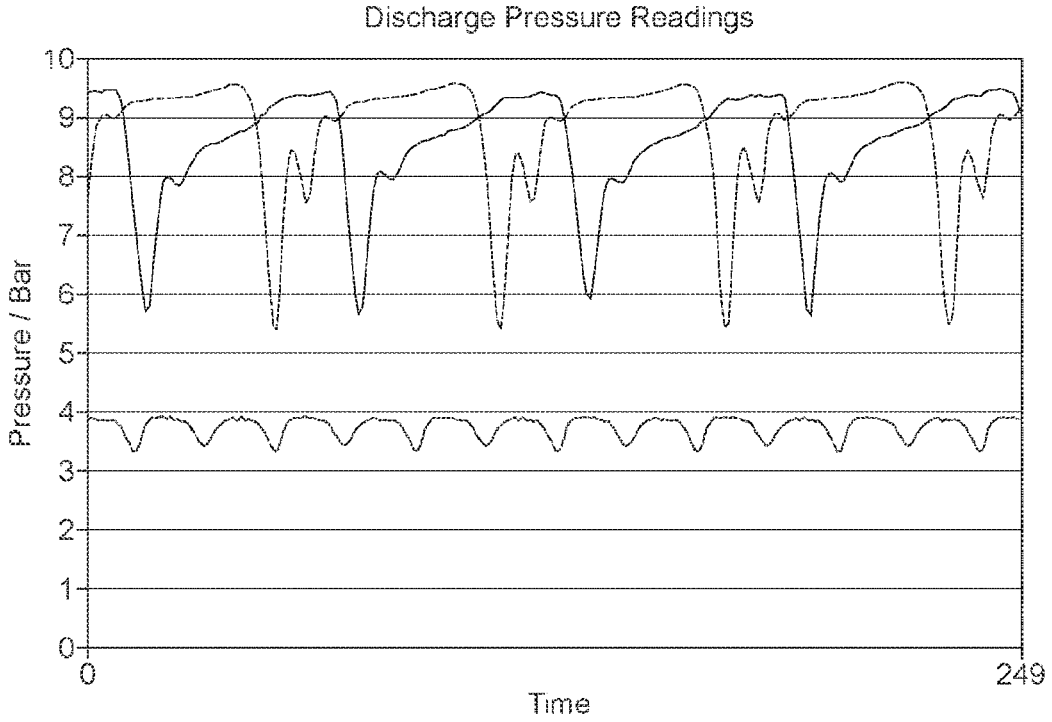
FIG. 3 is a graph of discharge pressure against time for two large, out of phase channels.
Figure 4:
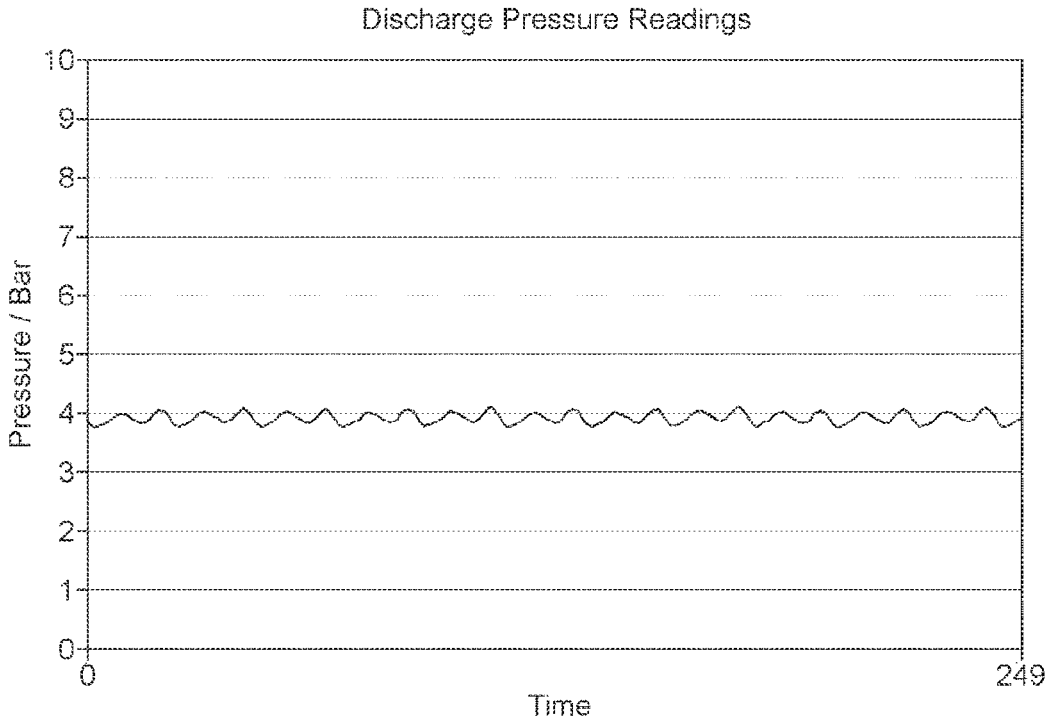
FIG. 4 is a graph of discharge pressure against time for two small, out of phase channels.
Figure 5:
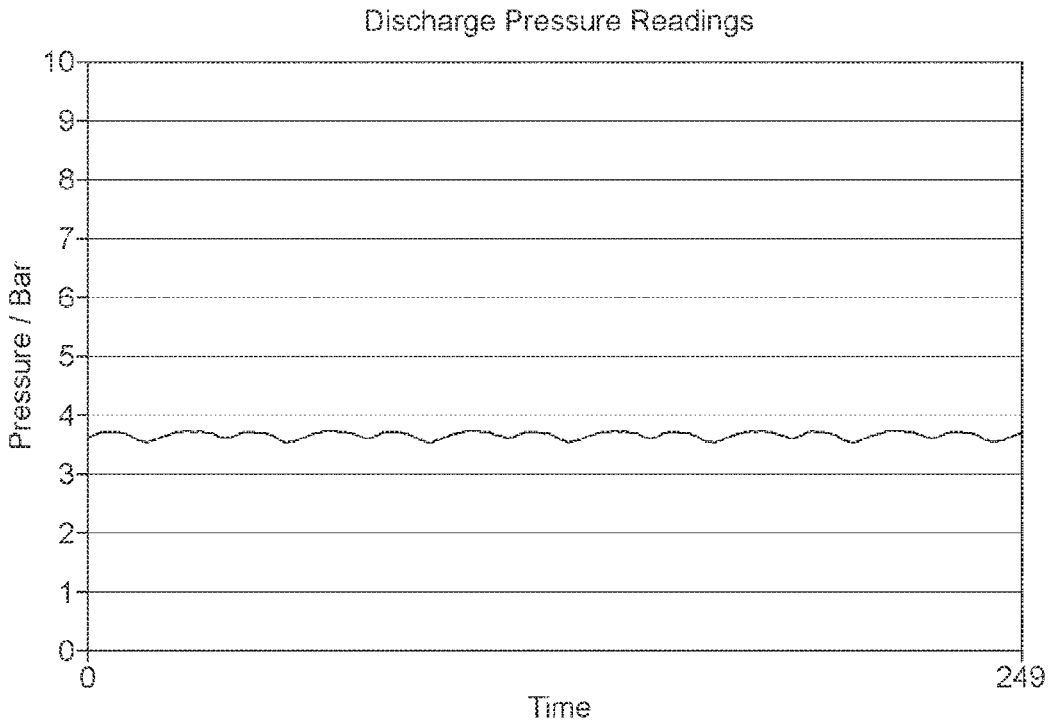
FIG. 5 is a graph of the resultant discharge pressure against time for two large and two small, out of phase channels.

FIG. 2 shows the discharge pressure for a single, larger diameter tube 12 and illustrates the pulsation exhibited in a single channel pump. In contrast, FIG. 3 shows the discharge pressure for two, larger diameter tubes 12 which are out of phase by 60° (note that the upper trace shows the pulsation of a similar pump for comparison purposes only). The resulting pulsation is higher in frequency (which may be perceived as demonstrating lower pulsation), but does not significantly reduce the amplitude of pulsation. As per FIG. 3, FIG. 4 shows the discharge pressure for two, smaller diameter tubes 12 which are out of phase by 60°. In comparison to the large tubes, the smaller tubes exhibit higher frequency, but smaller amplitude pulses. FIG. 5 shows the discharge pressure for the pumphead 2 described with reference to FIG. 1 comprising two larger and two smaller tubes which may considered to be a superposition of FIGS. 3 and 4. As shown, the addition of the lower amplitude pulse from the smaller tubes significantly reduces the amplitude of the pulsation resulting from the larger tubes. This combination has been found to provide a pulsation amplitude of ±0.1 bar at a discharge pressure of 4 bar (RMS).

It will be appreciated that the concepts described previously may be extended to pumps having different numbers of rollers and to different numbers of channels.

For example, the rotor 4 may have four rollers 6 spaced from one another by 90°. In this case, the tracks also have an arc of 90°. In order to dampen the higher frequency pulsation generated by a four roller rotor, the angular offset between each track 10 is reduced. Specifically, for a pump having a swept volume v, the angular offset θ between each track may be defined as $\theta = v/n$, where n is the number of channels (i.e. tubes). Therefore, for a four roller rotor having a swept volume of 90° and four channels, the offset between each track 10 would be set to be 22.5°. The positioning of the tracks 10 may have a tolerance associated with it of ±5° such that the angles deviate slightly from those prescribed above.

Additional channels may also be used, if desired. An even number of channels (i.e. $n=2m$, where m is a positive integer ≥2) should, however, be used to achieve the dampening effect described above. Where different sized tubes are used, these should be paired with an angular offset of 2θ. Thus, for a six channel pump with a swept volume of 120°, the pairs of equal diameter tubes 12 should be offset from one another by 40°. The equal diameter tubes should be provided in pairs or multiples of two. Therefore, for a six channel pump, it is necessary to use three different sizes of tube.

The tubes 12 and their respective tracks 10 may be reordered from that shown and described. For example, the smaller and larger tubes may be interleaved with one another.

Although the pump has been described as having offset tracks, it will be appreciated that the same effect may be achieved using a rotor with offset lobes.

The invention is not limited to the embodiments described herein, and may be modified or adapted without departing from the scope of the present invention.

The invention claimed is:

1. A peristaltic pump comprising:

a rotor; and a track assembly spaced from the rotor to receive n tubes therebetween, the tubes being manifolded to one another at a discharge port, wherein one of the rotor and the track assembly includes an occlusion surface for each of the n tubes, wherein the occlusion surfaces are located at n different angular positions, the angular offset between the occlusion surfaces offsetting pulsation associated with each tube so as to reduce overall pulsation at the discharge port, wherein the n tubes comprise pairs of tubes, wherein each of the tubes within a pair have substantially a same diameter and wherein at least two of the pairs of tubes have different diameters, wherein the pairs of tubes are arranged such that the angular positions of the corresponding occlusion surfaces are interleaved for a pair of smaller tubes and a pair of larger tubes.

2. A peristaltic pump as claimed in claim 1, wherein an angular offset θ between each occlusion surface is substantially equal to v/n, where v is a swept volume of the occlusion surface.

3. A peristaltic pump as claimed in claim 1, wherein the track assembly includes n track sections each defining one of the occlusion surfaces, wherein the track sections are angularly offset from one another.

4. A peristaltic pump as claimed in claim 1, wherein the rotor includes a plurality of rollers.

5. A peristaltic pump comprising:

a rotor; and a track assembly spaced from the rotor to receive n tubes therebetween, wherein the n the tubes comprise pairs of tubes, the tubes being manifolded to one another at a discharge port, wherein one of the rotor and the track assembly includes an occlusion surface for each of the n tubes, wherein the occlusion surfaces are located at n different angular positions, the angular offset between the occlusion surfaces offsetting pulsation associated with each tube so as to reduce overall pulsation at the discharge port, wherein the track assembly includes n track sections each defining one of the occlusion surfaces, wherein the track sections are angularly offset from one another.

6. A peristaltic pump as claimed in claim 5, wherein each of the tubes within a pair have substantially a same diameter and wherein at least two of the pairs of tubes have different diameters.

7. A peristaltic pump as claimed in claim 6, wherein the pairs of tubes are arranged such that the angular positions of the corresponding occlusion surfaces are interleaved for a pair of smaller tubes and a pair of larger tubes.

8. A peristaltic pump as claimed in claim 5, wherein an angular offset $\theta$ between each occlusion surface is substantially equal to $v/n$, where $v$ is a swept volume of the occlusion surface.

9. A peristaltic pump as claimed in claim 5, wherein the rotor includes a plurality of rollers.

* * * * *